United States Patent [19]

Gärtner et al.

[11] Patent Number: 4,530,669

[45] Date of Patent: Jul. 23, 1985

[54] METHOD OF MAKING A BORIDED DISPENSER CATHODE

[75] Inventors: Georg Gärtner, Aix-la-Chapelle, Fed. Rep. of Germany; Egbert B. G. W. Gotjé, Eindhoven, Netherlands

[73] Assignee: U.S. Philips Corporation, New York, N.Y.

[21] Appl. No.: 468,224

[22] Filed: Feb. 22, 1983

[30] Foreign Application Priority Data

Mar. 5, 1982 [NL] Netherlands ..... 8200903

[51] Int. Cl.[3] ..... H01J 9/04

[52] U.S. Cl. ..... 445/51; 148/20.3; 445/50

[58] Field of Search ..... 148/6.3, 20.3, 31.5, 148/16.5, 16; 427/248.1; 445/50, 51; 313/346 DC

[56] References Cited

U.S. PATENT DOCUMENTS

| | | | |
|---|---|---|---|
| 1,909,680 | 5/1933 | Hunter, Jr. | 445/51 X |
| 2,107,945 | 2/1938 | Hull et al. | 313/346 DC |
| 2,494,267 | 1/1950 | Schlesinger et al. | 148/16 X |
| 3,016,472 | 1/1962 | Coppola | 313/346 DC |
| 4,369,392 | 1/1983 | Hotta et al. | 313/346 DC X |

*Primary Examiner*—Evan K. Lawrence
*Attorney, Agent, or Firm*—Robert J. Kraus

[57] ABSTRACT

A borided dispenser cathode of the type including a metallic base material is made by cleaning the cathode by annealing it in a hydrogen-containing atmosphere, depositing boron on the cathode by heating the cathode in an atmosphere containing a gaseous boron compound, and forming a boride of the metallic base material by heating the cathode to its operating temperature in a non-reactive atmosphere and maintaining the temperature for a time period sufficient to enable deposited boron to combine with the metallic base material.

5 Claims, 2 Drawing Figures

METHOD OF MAKING A BORIDED DISPENSER CATHODE

BACKGROUND OF THE INVENTION

The invention relates to a method of making a borided dispenser cathode comprising a high melting temperature base material in which the emissive material is present in the form of a metal oxide, which metal oxide is reduced continuously during operation of the cathode and the metal diffuses to the surface in atomic form and forms there a monoatomic film. Such cathodes are used, for example, in magnetrons, transmitting tubes, X-ray tubes and klystrons.

The film forms a dipole surface layer as a result of which the work function is reduced below that of pure emitter material. Examples of such film cathodes are the thoriated carburized tungsten cathode (Th-$[W]_c$) and the carburized lanthaniated molybdenum cathode (La-$[Mo]_c$). Similar cathodes with other rare earth metals and with alkaline earth metals as emitters are also known. An improvement of the emissive properties is obtained by the carburization. Carburization of a thoriated-tungsten cathode is carried out, for example, in an organic vapour (for example, an $H_2$-benzene mixture) at 1,600° to 2,000° C. The activating process in such a carburized cathode is less critical, the life of the cathode is extended, and higher emission current densities during continuous operation of the cathode are achieved. Such cathodes are also less sensitive to ion bombardment and the evaporation of the emitter material is smaller than in a non-carburized cathode.

A method of making a borided dispenser cathode is known from Izvestiya Akademii Nauk S.S.S.R., Neorganischeskie Materialy, Vol. 15, No. 1, pp. 64–67, January, 1979. The replacement by a boride (WB, $W_2B$) of the carbide layer formed during the carburization improves the emission properties of thoriated tungsten. In the method described in this article, boron is provided in a thoriated tungsten wire by roasting it in a powder mixture which comprises boron. It is also possible to provide boron by brushing a boron carbide suspension on the cathode and then heating it. Making borided cathodes in a powder mixture or by means of a suspension requires a number of extra treatments in the production process.

SUMMARY OF THE INVENTION

It is an object of the invention to provide a method of making borided dispenser cathodes, which method can be carried out in apparatus which has hitherto been used for carburizing said cathode.

A method of making a borided dispenser cathode of the kind described in the opening paragraph is characterized according to the invention in that the method comprises the following steps:

(a) cleaning the cathode by annealing in a hydrogen-containing atmosphere, (b) heating the cathode in a gas atmosphere which contains a gaseous boron compound at such a temperature that boron is deposited on the cathode, and (c) heating the cathode in a vacuum or a non-reactive atmosphere to the operating temperature of the cathode and keeping it at said temperature until a boride of the basic material is formed. The hydrogen-containing atmosphere comprises, for example, pure hydrogen or a mixed gas comprising a rare gas, nitrogen and hydrogen.

The gaseous boron compound is preferably diborane ($B_2H_6$). This compound is inexpensive and is sufficiently available. However, it is alternatively possible to use $B_4H_{10}$ (for a temperature higher than or equal to 16° C.) or $B_5H_9$ (for a temperature higher than or equal to 59° C.) or one of the gases $BF_3$, $BCl_3$, $BBr_3$ mixed with $H_2$. Solid or liquid boron compounds in vapour form and mixed with a carrier gas may also be used. For example, decaborane ($B_{10}H_{14}$) having a melting-point of 99.5° C. and a boiling point of 213° C., can be vaporized very readily.

Because boron is less rigidly bonded to the basic material (tungsten, molybdenum etc.,) than carbon, the boron can better contribute by diffusion to the reduction of the emissive material (oxide). The reduction of the emitter material during the life of the cathode can also occur in areas situated further away from the cathode surface.

The invention provides many advantages. Experiments have demonstrated that the saturation emission of borided cathodes is approximately 1.5 times as large as the saturation emission of carburized cathodes.

The reaction product of the metal oxide in carburized cathodes is carbon monoxide (CO) and in borided cathodes it is boron oxide ($B_2O_3$). CO has a vapour pressure of 1 at. at 191° C. and $B_2O_3$ has a vapour pressure of 1 at. at 1860° C. In tubes having a carburized cathode a considerable quantity of gas is hence liberated from the cathode in the form of CO. In tubes having borided cathodes the vapour pressure of $B_2O_3$ is so low that only the degassing of the remainder of the components of the tube need be taken into account. In magnetrons, a better emission reduces the filament voltage at which the tube continues to operate normally and effects more stable behaviour of the magnetron. In transmitter tubes, a higher emission combined with a smaller cathode-grid spacing leads to a larger product of gain and bandwidth. Moreover it is possible to reduce the cathode temperature for borided cathodes in transmitting tubes so that tubes having a longer life are obtained.

A longer life is also achieved because of the better diffusion of boron. Emitter material is reduced in parts of the cathode which upon carburization of the surface are no longer reached as a result of carbon deficiency associated with a worse carbon diffusion. As a result of this the emitter material can be more effectively used.

Boriding can be carried out in apparatus which has hitherto been used for carburizing cathodes.

By roughening the cathode prior to boriding, for example, by sandblasting it with tungsten carbide or by etching it, a rough surface is obtained which facilitates better adhesion of the boron layer to the cathode.

It is known from British Patent Specification No. 7655 to increase the electric resistance of the filaments of lamps by treating them with boron. This is carried out at a very high temperature (white heat) in order to prevent a layer of boron or carbon from being formed. In the method according to the invention much lower temperatures are used during the treatment in the boron containing atmosphere and a boron layer is formed. A method as described in the above-mentioned British Patent Specification would result in the formation of boron clusters in the gas and no boron layer would be deposited on the tungsten-thorium cathode.

The invention may be used for boriding both directly heated and indirectly heated dispenser cathodes (wires, pressed matrix, etc.)

BRIEF DESCRIPTION OF THE DRAWING

Some embodiments of the invention will now be described in greater detail with reference to the following examples and to the accompanying drawing, in which.

DESCRIPTION OF THE PREFERRED EMBODIMENTS

EXAMPLE 1

Figure 1:
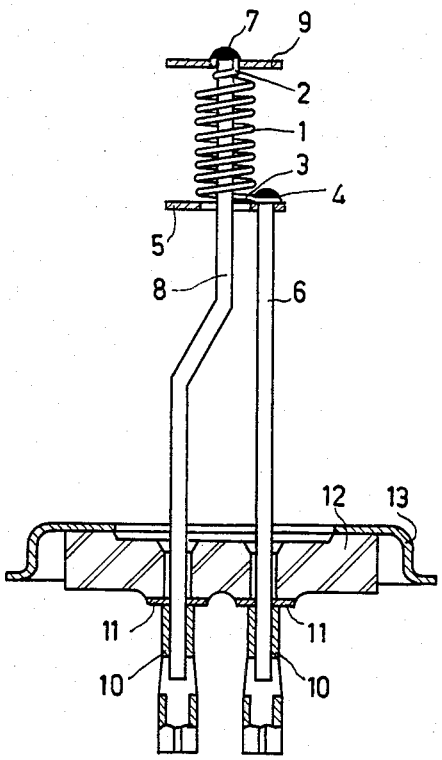
FIG. 1 is a side sectional elevation of a coiled, directly heated magnetron cathode.

A directly heated magnetron cathode coil 1 of thoriated tungsten, as shown in FIG. 1, consisting of eight turns having a wire thickness of 0.6 mm, a diameter of 5 mm, and a coil length of 10 mm, is sandblasted with tungsten carbide and is then heated in a hydrogen atmosphere. The coil 1 is then heated in a gas mixture of diborane and argon at a temperature of 600° C. by passing a current of 7.5 A through this coil. After 5 minutes the diborane-argon mixture is removed and the current through the cathode which is now in a vacuum (pressure $1.3.10^{-3}$ Pa) is increased to 19 A and kept at 19 A for 5 minutes. Instead of a vacuum a dry hydrogen atomsphere (e.g. at atmospheric pressure) can be used. The temperature of the coil 1 during this treatment is 1600° C. The cathode coil 1 comprises an inwardly bent upper end 2 and a tangentially extending lower end 3. This lower end 3 is connected to a molybdenum end plate 5 and a supporting rod 6 by means of a weld 4. The upper end 2 is connected to a central supporting rod 8 and the end plate 9 by means of a weld 7. The supporting rods 6 and 8 are mounted in an alumina plate 12 by means of copper tubes 10 and sealing rings 11, and the alumina plate 12 is sealed to an annular base plate 13.

EXAMPLE 2

Figure 2:
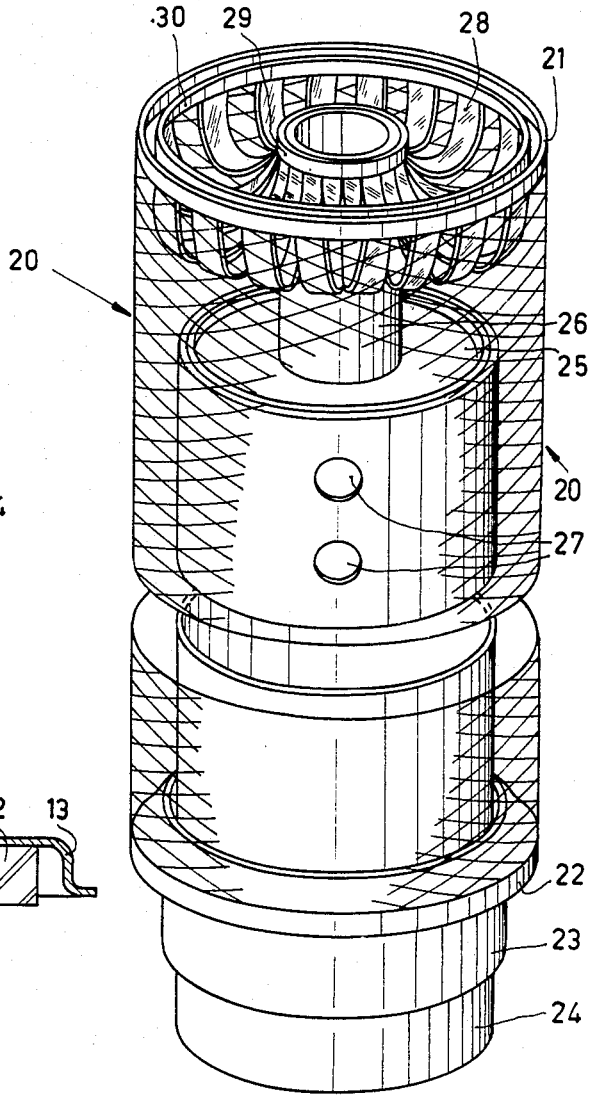
FIG. 2 is a side elevation of a mesh cathode for a transmitter tube.

FIG. 2 diagrammatically shows a mesh cathode 20 constructed from wires 30 of lanthaniated molybdenum extending according to a left-hand thread and extending according to a right-hand thread, the wires being welded together at the crossings. The cathode wires have a thickness of 0.45 mm and form a cathode having a length of 257 mm and a diameter of 78.8 mm. At one end, the cathode 20 is welded to an outer ring of a circular rectangular metal channel 21 and at the other end to a circular ring 22, which ring forms an end of a hollow metal supporting cylinder 23. Within the hollow cylinder 23 and the cathode 20 the hollow metal cylinder 24 extends coaxially and forms part of a filament current circuit of the cathode 20. The cylinder 24 merges into a hollow cylinder 26 of a smaller diameter via a dish-shaped member 25. The holes 27 in the cylinder 24 give access to a few non-evaporating getters positioned behind the holes. Thin molybdenum bands 28 are connected to the free end of the cylinder 24 and are clamped between the cylinder wall and a band 29 also consisting of molybdenum. From this connection the bands 28 initially extend axially, then describe an approximately semicircular arc and finally terminate again in the axial direction between a molybdenum band 30 and the inner ring of the cathode channel 21. The cathode is heated in pure hydrogen and is then subjected to a mixture of $B_4H_{10}$ and argon at 700° C. After five minutes the $B_4H_{10}$ mixture is removed and the cathode is heated to 1400° C. for 5 minutes. This heating is preferably carried out in the sealed transmitter tube during evacuation. An La-$[Mo]_b$ cathode is formed which has a considerably longer life than carbonized lanthanum molybdenum cathodes, because no local boron deficiency occurs.

EXAMPLE 3

A cathode of the shape as shown in FIG. 2 consists of wires of ceriated tungsten (having therein a few percent cerium oxide). This cathode is heated in a gas mixture including helium, nitrogen and hydrogen and is then heated to 800° C. in a mixture of $BF_3$ and $H_2$. After five minutes the $BF_3$—$H_2$ mixture is removed and the cathode is heated to approximately 1400° C. for five minutes in dry hydrogen at atmospheric pressure. In this manner a Ce-$[W]_B$ cathode is formed.

EXAMPLE 4

A cathode of the shape as shown in FIG. 1 consists of a coil of gadoliniated tungsten (including a few percent gadolinium oxide—$Gd_2O_3$). This cathode is cleaned by heating in pure hydrogen and is then heated to 600° C. and placed in a mixture of $BCl_3$ and $H_2$, which mixture is removed after five minutes. The cathode is then kept at a temperature of 1600° C. for five minutes, a Gd—$[W]_B$ cathode being formed.

What is claimed is:

1. A method of making a borided dispenser cathode of the type comprising a metallic base material containing a metal oxide emissive material which continuously diffuses to the cathode surface during operation, said metallic base material being capable of forming a boride compound when exposed to boron at the cathode's operating temperature, said method comprising the steps of:

(a) cleaning the cathode by annealing it in a hydrogen-containing atmosphere;

(b) depositing boron on the cathode by heating the cathode in an atmosphere containing a gaseous boron compound; and (c) forming a boride of the metallic base material by heating the cathode to its operating temperature in a nonreactive atmosphere and maintaining said temperature for a time period sufficient to effect the reaction of deposited boron with the metallic base material.

2. A method as in claim 1 where the gaseous boron compound is diborane ($B_2H_6$).

3. A method as in claim 1 or 2 where the metallic base material is roughened prior to performing the cleaning step.

4. A method as in claim 1 or 2 where the emissive material consists essentially of an oxide of one of the metals of group III-B of the periodic table.

5. A method as in claim 4 where the emissive material consists essentially of thorium-oxide and where the base material consists essentially of tungsten.

* * * * *